US008782855B2

(12) United States Patent
Lampignano

(10) Patent No.: US 8,782,855 B2
(45) Date of Patent: Jul. 22, 2014

(54) THEFT-PROTECTION SYSTEM AND DEVICE, IN PARTICULAR FOR OPEN POCKETS

(76) Inventor: Sebastiano Paolo Lampignano, Triggiano (IT)

( * ) Notice: Subject to any disclaimer, the term of this patent is extended or adjusted under 35 U.S.C. 154(b) by 368 days.

(21) Appl. No.: 13/381,539

(22) PCT Filed: Jun. 21, 2010

(86) PCT No.: PCT/IB2010/052803

§ 371 (c)(1),
(2), (4) Date: Dec. 29, 2011

(87) PCT Pub. No.: WO2011/004280

PCT Pub. Date: Jan. 13, 2011

(65) Prior Publication Data

US 2012/0096689 A1 Apr. 26, 2012

(30) Foreign Application Priority Data

Jul. 8, 2009 (IT) ..... BO2009A0440

(51) Int. Cl.

| | |
|---|---|
| ***A45F 5/00*** | (2006.01) |
| ***A45C 13/18*** | (2006.01) |
| ***A41D 27/20*** | (2006.01) |
| *A45C 13/20* | (2006.01) |

(52) U.S. Cl.

CPC ..... *A41D 27/201* (2013.01); *A45F 5/00* (2013.01); *A45C 13/18* (2013.01); *A45C 13/20* (2013.01)

USPC ..... 24/3.5; 150/134

(58) Field of Classification Search

CPC ..... A45C 13/185; A45F 5/00

USPC ..... 24/3.5, 306; 150/134

See application file for complete search history.

(56) References Cited

U.S. PATENT DOCUMENTS

| | | | | |
|---|---|---|---|---|
| 2,908,306 | A | 10/1959 | Chorost | |
| 3,822,446 | A * | 7/1974 | Silverstein | 24/3.5 |
| 4,121,323 | A | 10/1978 | Letostak | |
| 4,639,980 | A * | 2/1987 | Peterson | 24/306 |
| 5,136,759 | A * | 8/1992 | Armour, II | 24/306 |
| 2003/0006260 | A1 * | 1/2003 | Bassett | 224/275 |

FOREIGN PATENT DOCUMENTS

GB 196541 A 4/1923

OTHER PUBLICATIONS

International Search Report for PCT/IB2010/052803, Mailed Oct. 6, 2010, 3 pages.

* cited by examiner

*Primary Examiner* — Robert J Sandy
(74) *Attorney, Agent, or Firm* — William J. Sapone; Ware Fressola; Maguire & Barber LLP

(57) ABSTRACT

A system and a device for anti-thief protection, especially for open pockets of trousers, bags and the like, includes a mobile protection strip element (1) to be applied on the pockets hooks (12). The aim is attained by superposing the strip (1) on the pocket (T) and blocking the strip (1) using a plurality of hooks (12) in the form of clips located in the lower part (5) of the strip (1), the strip (1) supported by support elements (G), located in the upper part (2) thereof, which insert or hook in the zone overlying the pocket (T) to be protected.

12 Claims, 2 Drawing Sheets

THEFT-PROTECTION SYSTEM AND DEVICE, IN PARTICULAR FOR OPEN POCKETS

TECHNICAL FIELD

The invention relates to a system and a device for theft-protection, especially for open pockets such as back pockets of trousers or external pockets of bags and/or back-packs carried on the shoulders.

DESCRIPTION OF THE BACKGROUND ART

It is known that products and accessories for clothing include numerous external pockets for containing personal objects such as spectacles, wallets, bunches of keys, documents, etc.

All of these objects are susceptible to theft on the part of thieves and muggers, an ever-present risk.

On the other hand, for aesthetic reasons and/or production costs, all of these pockets are generally without closing means, such as: buttons, buckles, zips or Velcro-type fastenings.

The application of the above-cited closing means following the acquisition of the article requires specialist work on the part of a tailor to provide buttonholes and to sew on buttons, to sew zip fastenings or others, with considerable additional costs and loss of time.

It is therefore indispensable, in order to prevent risk of theft, to provide these open pockets with a closing means that can be bought after production and sale of the article of clothing itself, and which is at the same time an effective anti-theft means, immediately applicable, simple to apply, not expensive and aesthetically acceptable. Further, the protection has to be easy to remove at any moment and also has to be transferable to another pocket.

SUMMARY OF INVENTION

The aim of the present invention is thus to develop an anti-theft protection system, further providing a suitable device for the protection itself.

The system consists in creating a strip-closure which is superposed on the pocket to realize a continuity of material, textile or leather between the upper border of the open pocket and a fixed part overlying the open pocket itself. Further, the strip must always be located at the centre of the pocket, such that the protection is as effective as possible, and is also pleasant aesthetically.

The closure is constituted essentially by a strip, preferably though not exclusively made of a textile material, shaped as a strap having a prevalently vertical development. In the upper part of the strip the closure comprises hooking means to the belt of the user, if used with trousers, or a ring, such that it can be used in the absence of a belt, as illustrated herein below; in the lower part it is constituted by two superposed flaps, of which a more internal flap comprises blocking means to an edge of the pocket to be protected.

The strips, thus made, do not require stable fastening operations, such as sewing or riveting, are easily applicable and dismountable with a simple manual operation; further, they enable application of the protection in the desired position, whether it is in the centre of the pocket or a non-central position thereon.

The use of the protection, once applied on the pocket, is practical and rapid and enables insertion and extraction from the pocket of objects by means of a simple opening and/or closing of the lower hooking devices.

In a preferred though not exclusive embodiment of application to back pockets of trousers, the strip is constituted by a strip of material, either the same as or different to the material of which the trousers are made, having a prevalent length with respect to the width.

During production, in the upper part of the strip a series of vertical holes are made, distanced by an appropriate step, having the aim of receiving a ring which contemporaneously crosses a single pair of holes. By moving the ring into different hole pairs, a different distance is obtained between the belt and the upper edge of the pocket, adapting in this way the length of the strip to the various sizes and/or models.

At the lower end, which is doubled by addition of an appendage on the internal part, during production a series of small horizontal holes are made, destined to receive support means (rings) of a pair of clips which are therefore covered at the internal part of the strip.

Any desired decorative motifs can be applied on the external side of the strip, where the clips are superposed.

The protection mounting, in the case of application to external trouser pockets, is done following the procedure as below:

1) the upper part of the strip is folded on itself, such as to superpose two holes, selected such as to leave a total length of the strip which is proportional to the belt-pocket distance. The end part of the folded portion is inserted in the internal loop predisposed to keep it in a stable position;
2) a ring is then inserted in the pair of superposed holes, using a hook connected to the ring, attached to the belt or a loop of material to be inserted in the belt, such as to support the strip;
3) after having inserted an object in the pocket, the protection strip is superposed on the centre of the pocket, and the strip is blocked solidly to the free edge of the pocket by means of the snap-fastening of the clips.

The pocket is therefore closed by the strip which, not being easily removable in this way, constitutes a valid protection for what is contained in the pocket.

The aims and advantages will better emerge from the description that follows and the appended tables or drawings which schematically illustrate, by way of example, a possible though not limiting practical embodiment of the invention which constitutes the present invention.

BRIEF DESCRIPTION OF THE DRAWINGS

With reference to the tables of the drawings.

DESCRIPTION OF THE PREFERRED EMBODIMENTS

Figure 1:
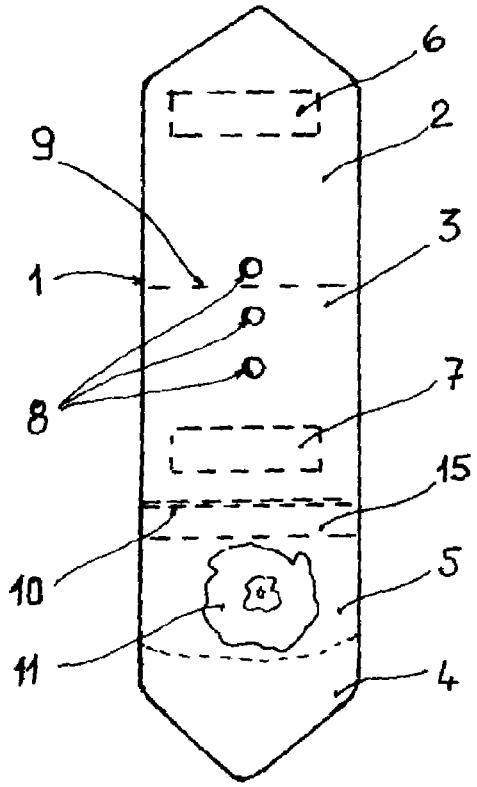
FIG. 1 illustrates the strip in a plan view from an external side.
Figure 2:
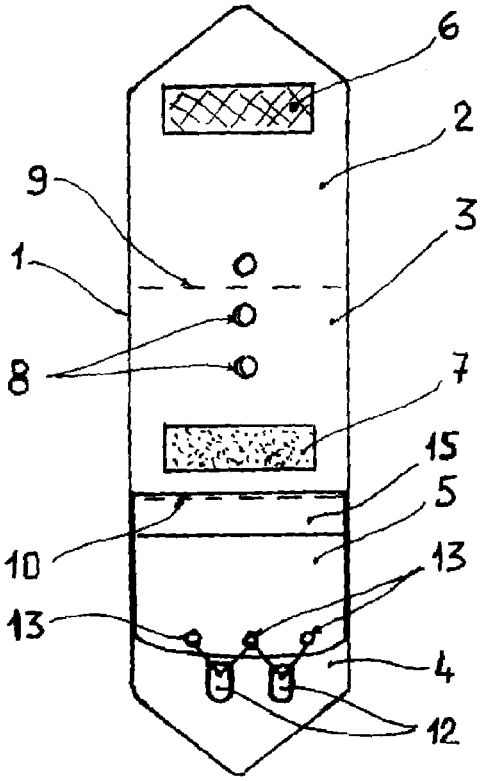
FIG. 2 illustrates a plan view from an internal side.

The protection (FIG. 1) is essentially constituted by a strip 1 made of a flexible material, in an upper part 2 of which a piece of adhesive known as a Velcro® hook and loop type fastener, is applied on the internal surface. Some holes 8 are afforded in the central part and a second piece of Velcro® fastener 7 is applied, again on the internal surface. In the lower part thereof the strip 1 is constituted by two superposed flaps, sewn to one another along the line 10, of which an external flap 4 is in a single piece with the rest of the strip 1 while a second strip forming a second flap 5 is sewn internally of the strip 1. A decorative motif or a mark or distinctive sign 11 can be applied on the external surface of the lower part 3.

Holes 13 are afforded in the flap 5, which is shorter than the lower flap 4; the holes 13 are designed to have clips 12 fastened thereto.

Further, a third strip 15 of material is sewn, again on the internal side at the position of the sewn seams 10, which third strip 15 functions as a loop.

Figure 3:
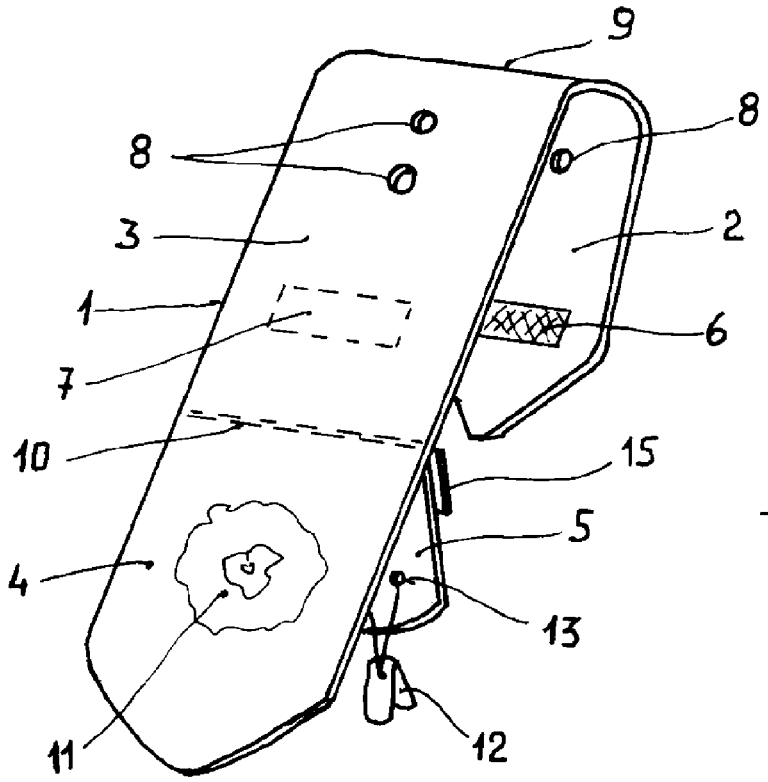
FIG. 3 illustrates a perspective view of the protection in the version for belts.
Figure 4:
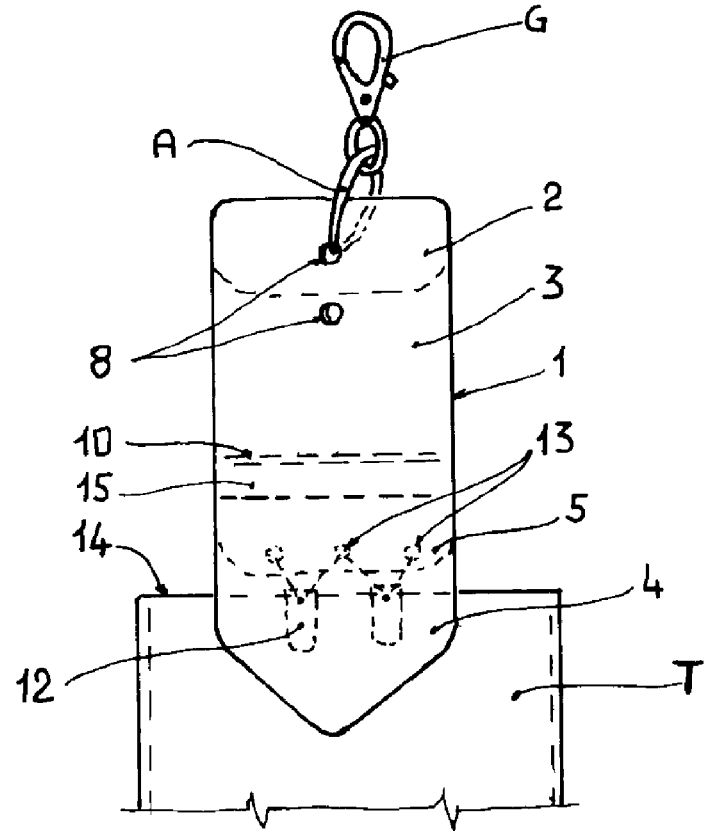
FIG. 4 is a plan view of the protection with the support hook.

The protection of the invention is applied, with special though not exclusive reference, to the back pockets of a pair of trousers, in a way which will be more fully described herein below (FIGS. 3 and 4).

The upper part 2 of the strip 1 is folded on itself along the line 9 such as to form a loop-shaped arch, and such that the Velcro® fastener 6 adheres to the corresponding Velcro® fastener 7. The very end of the portion 2 is inserted, for security reasons, in the loop 15.

The loop, thus-formed, can be inserted in the belt of the trousers, not illustrated.

To close the pocket T, the two flaps 4 and 5 are located over the upper edge 14 of the pocket T, by hooking the clips 12 to the external wall of the pocket T.

In this way the strip 1 is made solid between the belt and the pocket T, preventing in this way that objects located internally of the pocket T can be removed.

In order to extract the object contained in the pocket T, it is sufficient to unhook the clips 12 from the edge of the pocket T and raise the strip 1.

A mugger will not be able to extract the contents of the pocket T, as the strong grip exerted by the clips, covered by the flap 4, prevents opening and raising of the protection and closure flap 1.

In the absence of a belt, or in a case where the protection is applied to the pocket T of a bag or a back-pack, the strip is applied superiorly of any element present on the main body, by means of a hook G inserted in a ring A passing through the upper holes 8.

In this case the length of the strip 1 is defined by the insertion of the ring A in the holes 8, combining two holes after having folded the upper part 2 on the corresponding central part 3.

The present invention, illustrated and described in a schematic and exemplary form, is extended to all accessory variants of materials, shape, dimensions, components and colours, which all fall within the ambit of the following claims.

The invention claimed is:

1. Theft-protection system for an open pocket of garments and bags comprising:

a first strip of flexible material, means for removably attaching the first strip onto the pocket to be protected, the first strip having an upper part and a lower part, the upper part having an upper flap that folds back along a line, the lower part having a first lower flap on an inner side of the lower part, a second strip stitched to the first lower flap and forming a second lower flap, and a third strip in the shape of a loop and secured to the inner side of the first lower flap for receiving an end portion of the upper flap.

2. The theft-protection system of claim 1 wherein the first strip is attached, by the upper part, to an integral element of a body on which the pocket is located.

3. The theft-protection system of claim 1 wherein the removable attaching means comprise a number of clips attached to the second flap of the first strip which fasten onto an upper edge of the pocket for securely fixing the first strip to the open pocket.

4. The theft-protection system of claim 1 wherein the upper part of the first strip folds back on itself to form an upper loop held in place by hook and loop type separable fasteners, and wherein the second flap is made of fabric.

5. The theft-protection system of claim 4 wherein the upper part of the first strip folds back on itself to form an upper loop, and further comprising a series of through holes arranged vertically in a row along the first strip for adjusting a height of the first strip when located in the pocket.

6. The theft-protection system of claim 5 further comprising a ring, provided with a hook, the ring being inserted through two of the through holes which are superimposed when the upper flap is folded over the upper portion.

7. The theft-protection system of claim 6 wherein the insertion of the ring (A) into the two through holes determines an overall length of the first strip between a connection point of the hook and an upper edge of the pocket.

8. The theft-protection system of claim 5 wherein the removable attaching means comprise two clips, the second lower flap having a number of holes through which are passed elements for supporting the two clips.

9. The theft-protection system of claim 4 wherein the second flap is shorter than the lower flap onto which it is stitched.

10. The theft-protection system of claim 9 wherein the removable attaching means comprise two clips, the second lower flap having a number of holes through which are passed elements for supporting the two clips.

11. The theft-protection system of claim 4 wherein the removable attaching means comprise two clips, the second lower flap having a number of holes through which are passed elements for supporting the two clips.

12. The theft-protection system of claim 4 wherein trademarks and/or decorative graphics are applied to an external surface of the lower part.

* * * * *